US006765141B2

(12) United States Patent
Shigenaga

(10) Patent No.: US 6,765,141 B2
(45) Date of Patent: Jul. 20, 2004

(54) FOOT PEDAL FOR DRUM

(75) Inventor: Fumihiro Shigenaga, Hamakita (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 10/372,344

(22) Filed: Feb. 25, 2003

(65) Prior Publication Data

US 2003/0159563 A1 Aug. 28, 2003

(30) Foreign Application Priority Data

Feb. 28, 2002 (JP) ..... P2002-053756

(51) Int. Cl.[7] ..... G10D 13/02
(52) U.S. Cl. ..... 84/422.1; 84/422.2; 84/422.3
(58) Field of Search ..... 84/422.1, 422.2, 84/422.3

(56) References Cited

U.S. PATENT DOCUMENTS 3,988,957 A * 11/1976 Escamilla ..... 84/422.1
4,048,896 A * 9/1977 Calato et al. ..... 84/422.1
4,873,910 A * 10/1989 Kurosaki ..... 84/422.1
5,565,637 A * 10/1996 Shigenaga ..... 84/422.1
5,646,360 A 7/1997 Liao
6,528,714 B1 * 3/2003 Liao ..... 84/422.3

FOREIGN PATENT DOCUMENTS

| | | |
|---|---|---|
| JP | 55-45433 | 10/1980 |
| JP | 58-43035 | 9/1983 |
| JP | 7-41036 | 9/1995 |
| JP | 8-314447 | 11/1996 |

* cited by examiner

*Primary Examiner*—Kimberly Lockett
(74) *Attorney, Agent, or Firm*—Dickstein, Shapiro, Morin & Oshinsky, L.L.P.

(57) ABSTRACT

A foot pedal for a drum (e.g., a bass drum) is constituted by a pedal frame, a rotation shaft, a rocker, a beater rod having a beater, a foot board, a depression transmission member, and a base plate whose front portion is affixed to a frame body by use of a screw and whose back portion is affixed to a heel. The head and external thread portion of the screw are engaged with a through hole having a keyhole shape formed in the front portion of the base plate. The base plate and pedal frame are subjected to prescribed positioning using projections and engagement holes, which are engaged with each other when the base plate and frame body are fixed together by tightening the screw, which can be loosened to allow removal of the base plate.

8 Claims, 4 Drawing Sheets

FOOT PEDAL FOR DRUM

BACKGROUND OF THE INVENTION

1. Field of the Invention

This invention relates to foot pedals for drums, in particular, bass drums, which are beaten by beaters (or mallets) interconnected with foot boards (or pedals) when depressed.

2. Description of the Related Art

Foot pedals are normally used for playing bass drums and are operated by users (or operators) who depress foot boards (or pedals) with their feet, thus rotatably moving beaters (or mallets) to beat drumheads of bass drums. Specifically, a beater rod is attached to a rotation shaft of the foot board via a rocker, so that when the foot board is depressed by operator's foot, a beater attached to the tip end of the beater rod is rotatably moved to beat the bass drum. Herein, the front end of the foot board is interconnected with the rocker via a depression transmission member such as a belt and a chain, while the back end of the foot board is interconnected with a heel, which is mutually interconnected with a pedal frame via an interconnection rod. The pedal frame and the heel are normally arranged on the floor surface. Various examples of foot pedals have been disclosed in Japanese Examined Utility-Model Publication No. Sho 55-45433, Japanese Examined Utility-Model Publication No. Sho 58-43035, and Japanese Unexamined Patent Publication No. Hei 8-314447, for example.

In the aforementioned foot pedal, the pedal frame and the heel are interconnected together in such a way that end portions of the interconnection rod are bent and are then detachably attached to holes formed at prescribed positions of the pedal frame, or they are fixed to prescribed positions of the pedal frame using fastening members such as bolts. Even when the pedal frame and the heel are interconnected together via the interconnection rod, there is a possibility that the foot board and the heel may be mutually shifted in position from each other due to bending or deflection of the interconnection rod during the play of a bass drum with the foot pedal, or they may be deflected to be partially floated above the floor surface. This causes problems in terms of stability in playing of the foot pedal.

Japanese Examined Utility-Model Publication No. Hei 7-41036 discloses an example of a foot pedal for a drum, which is designed to improve the stability in playing by solving the aforementioned problems. This foot pedal is characterized by replacing the interconnection rod with a base plate (or a stabilizing board), which are fixed to both sides of the pedal frame by use of bolts.

The aforementioned example of the foot pedal requires two bolts in order to secure fixation of the base plate to the pedal frame; hence, the total number of bolts required for assembling the foot pedal must be increased, and it takes a relatively long time to attach and detach the base plate and the pedal frame. In addition, bolts are partially projected from both sides of the pedal frame, which deteriorates the exterior appearance of the foot pedal and which increases dimensions in width of the pedal frame. Furthermore, there is a problem in that the user (or operator) may slip his/her foot on the bolt(s) during the playing of a bass drum with the aforementioned foot pedal.

SUMMARY OF THE INVENTION

It is an object of the invention to provide a foot pedal for a drum, which allows the operator to easily and promptly attach and detach a base plate with a pedal frame in assembly.

A foot pedal for a drum according to this invention is basically constituted by a pedal frame, a rotation shaft, a rocker, a beater rod having a beater, a foot board, and a base plate. Herein, the rocker to which the beater rod is firmly attached is fixed to the rotation shaft that is bridged and rotatably supported between upper ends of support members planted on the upper surface of a frame body of the pedal frame. In addition, the front end of the foot board is interconnected with the rocker via a depression transmission member, and the back end of the foot board is interconnected with a heel. Furthermore, the front portion of the base plate is affixed to the lower surface of the frame body of the pedal frame, and the back portion of the base plate is affixed to the lower surface of the heel.

In the above, the front portion of the base plate and the lower surface of the frame body of the pedal frame are firmly fixed to each other using a screw and are appropriately positioned using engagement means such as projections and engagement holes.

Specifically, the head and external thread portion of the screw are projected from the lower surface of the frame body and are engaged with a through hole that is formed in the front portion of the base plate, so that when the base plate is combined with the frame body of the pedal frame, the screw is tightened to fix the base plate and the frame body of the pedal frame together.

The through hole has a keyhole shape consisting of a circular portion and an extended portion that is extended from the circular portion in a backward direction of the base plate and that has a prescribed width smaller than a diameter of the circular portion, so that the external thread portion of the screw initially engaged with the circular portion of the through hole of the base plate is moved backwards and is engaged with the extended portion of the through hole when the base plate is moved backwards in order to combine the base plate and the frame body of the pedal frame together.

Furthermore, a nonslip board is attached to the backside surface of the front portion of the base plate, and it has an elongated hole (51) substantially matched with the through hole of the base plate. In addition, a secondary nonslip board is also attached to the backside surface of the back portion of the base plate.

According to this invention, it is possible to reliably remove the base plate from the pedal frame by merely loosening the screw without completely removing the screw from the frame body of the pedal frame, thus safely releasing engagement between the base plate and the frame body of the pedal frame.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

This invention will be described in further detail by way of examples with reference to the accompanying drawings.

Figure 1:
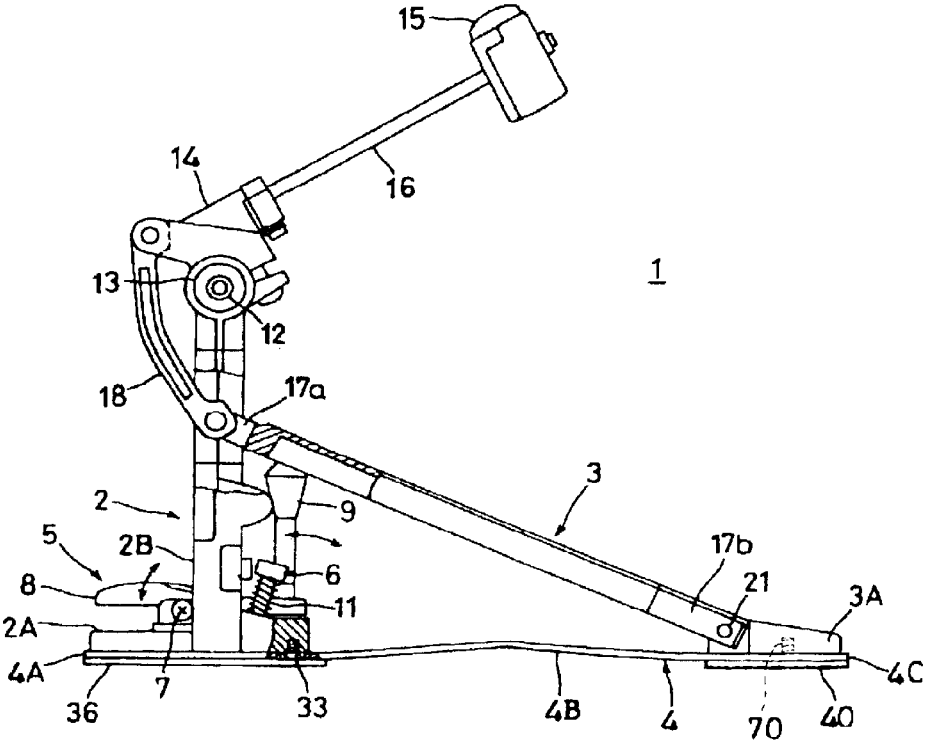
FIG. 1 is a side view partly in cross section showing a foot pedal for a drum in accordance with a preferred embodiment of the invention.
Figure 3:
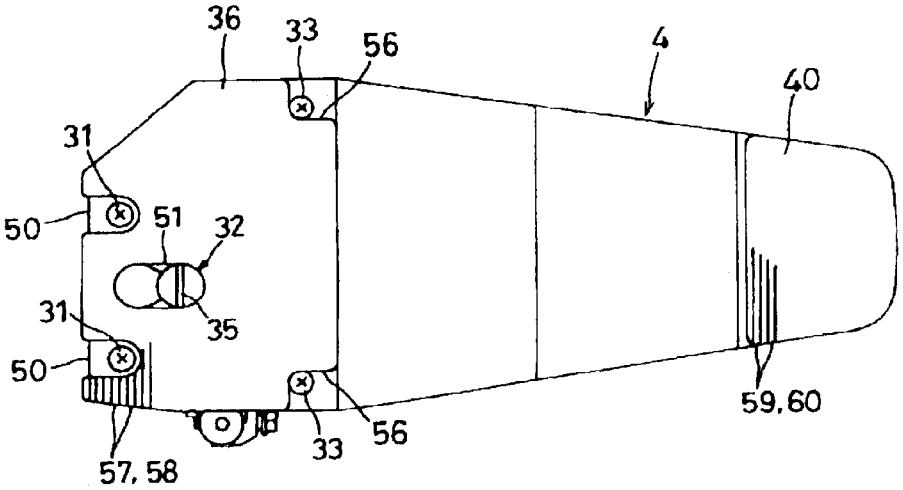
FIG. 3 is a bottom view of the foot pedal shown in FIG. 1.
Figure 2:
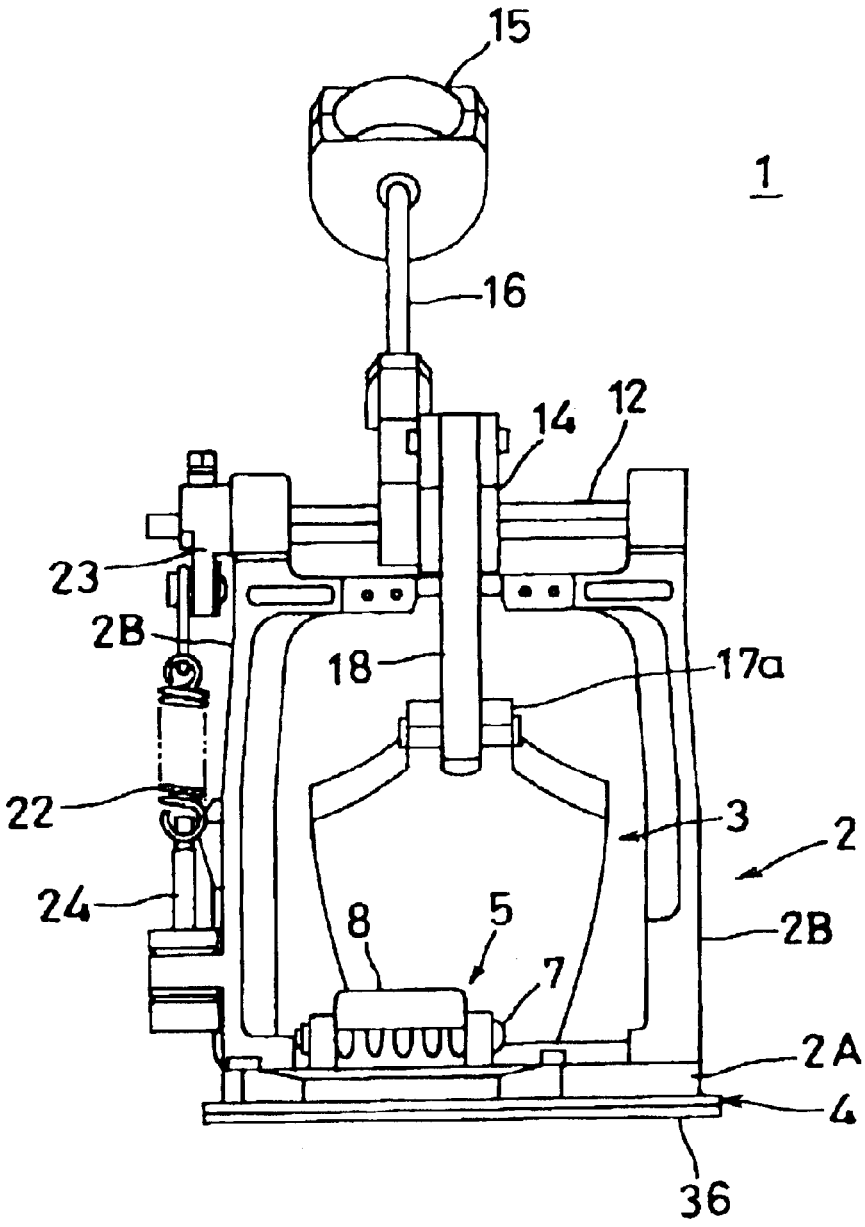
FIG. 2 is a back view of the foot pedal shown in FIG. 1.
Figure 4:
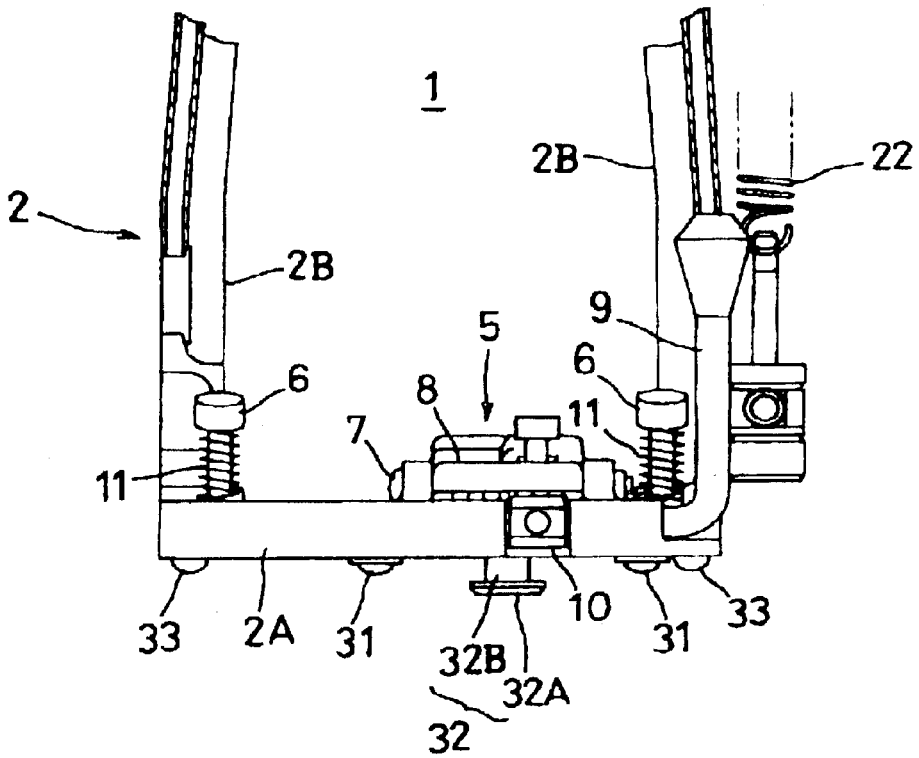
FIG. 4 is a front view showing a pedal frame that constructs the foot pedal of FIG. 1 and that is not equipped with a base plate.
Figure 5:
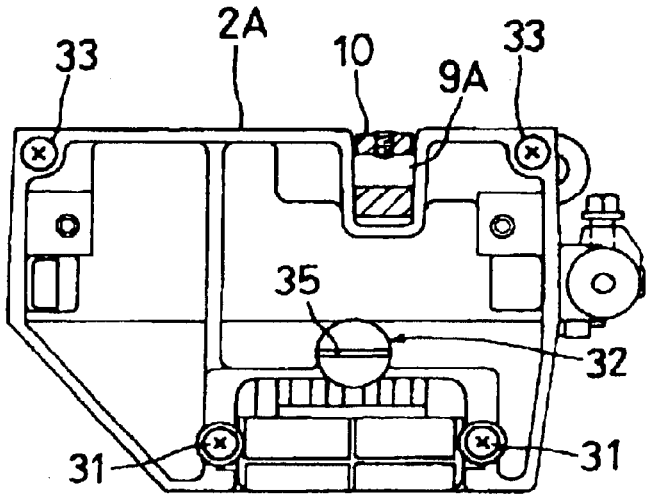
FIG. 5 is a bottom view of the pedal frame shown in FIG. 4.
Figure 6:
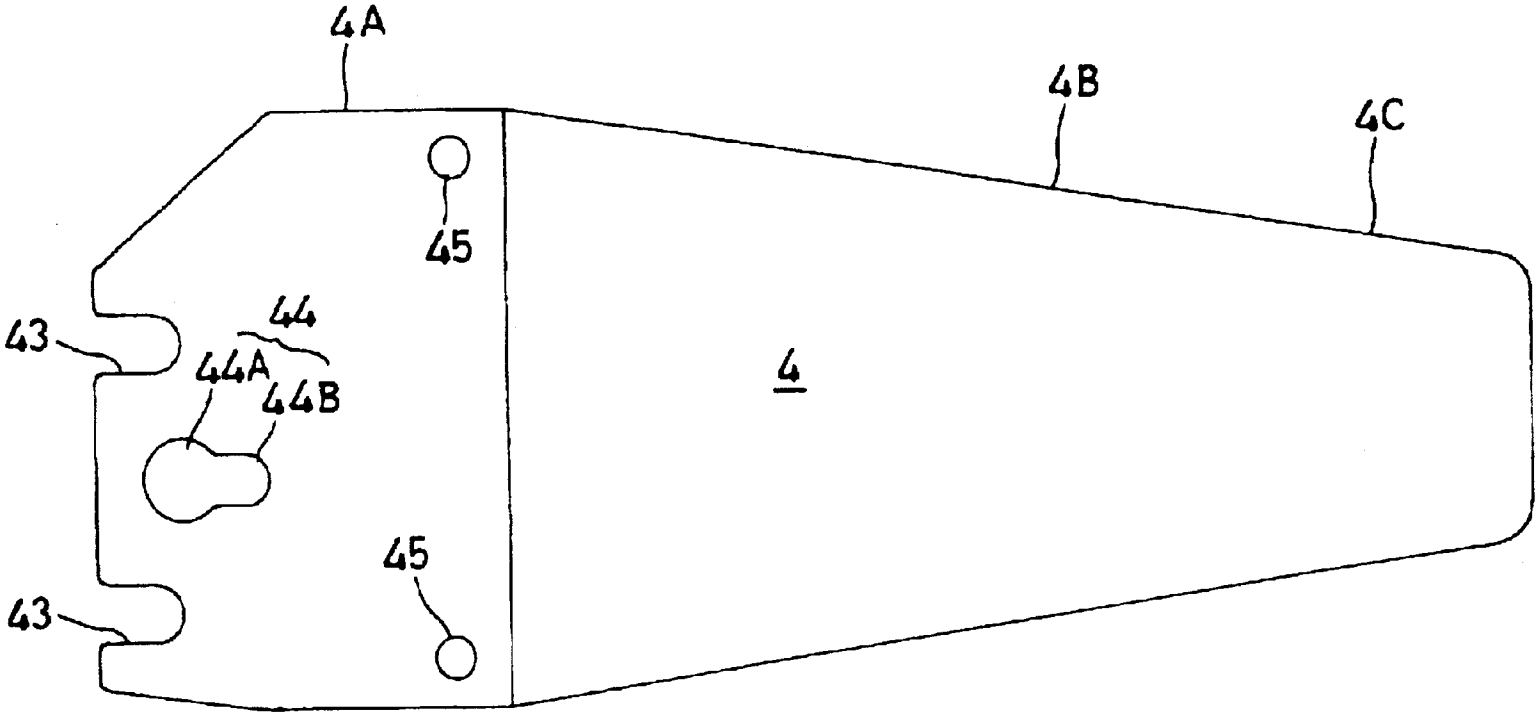
FIG. 6 is a plan view showing the base plate that is equipped with the pedal frame of the foot pedal.

FIG. 1 is a side view partly in cross section showing a foot pedal for a drum in accordance with the preferred embodiment of the invention. FIG. 2 is a back view of the foot pedal; FIG. 3 is a bottom view of the foot pedal; FIG. 4 is a front view showing essential parts of a pedal frame, which is not equipped with a base plate; FIG. 5 is a bottom view of the pedal frame; and FIG. 6 is a plan view of the base plate.

As shown in FIGS. 1 to 6, a foot pedal 1 is equipped with a pedal frame 2 that is arranged on the floor surface. The pedal frame 2 is made of aluminum alloy and is produced by die casting. Specifically, the pedal frame 2 is constituted by a frame body 2A having a plate-like shape and a pair of support members 2B, which are integrally formed together with the frame body 2A and are planted on both sides of the frame body 2A. In addition, a heel 3A of a foot board 3 is interconnected with the frame body 2A in the front side via a base plate (or a stabilizing board) 4, details of which will be described later. Furthermore, a (metal) clamping device 5 and two anchor screws 6 are attached onto the upper surface of the frame body 2A.

The clamping device 5 is constituted by a clamp member 8, a rotation lever 9, and a cam 10. Specifically, the intermediate portion of the clamp member 8 is supported to be rotatably moved in a vertical direction by a shaft 7; the rotation lever 9 (see FIGS. 1 and 4) having an "L" shape is rotatably moved in forward-backward directions; and the cam 10 is fixed to a rotation shaft portion 9A of the rotation lever 9 (see FIG. 5), so that when the rotation lever 9 is rotated by a prescribed angle in a clockwise direction in FIG. 1, the backend portion of the clamp member 8 is pressed upwards from its lower side so that the clamp member 8 is forced to rotate in the counterclockwise direction in FIG. 1. When the clamp member 8 is forced to rotate in the counterclockwise direction in FIG. 1 by means of the cam 10, a clamp frame (or a hoop, not shown) is tightly held between the clamp member 8 and the upper surface of the frame body 2A.

An anchor screw 6 prevents both the foot pedal 1 and a bass drum (not shown) from being unexpectedly moved due to impact that is caused when the user (or operator) depresses the foot board 3 with his/her foot during the playing of the bass drum. That is, the anchor screw 6 is equipped with a compression coil spring 11, by which the anchor screw 6 is forced to move towards the floor surface.

A rotation shaft 12 is bridged between the upper end portions of the support members 2B, which are planted on the upper surface of the frame body 2A in the pedal frame 2. That is, both ends of the rotation shaft 12 are axially supported by bearings 13, which are incorporated into the upper end portions of the support members 2B. A rocker 14 is fixed to the center portion of the rotation shaft 12. In addition, a beater 15 used for actually beating the drumhead of a bass drum is attached to the tip end of a beater rod 16, which is fixed to the rocker 14. Furthermore, a front end portion 17*a* of the foot board 3 is interconnected with the rocker 14 via a depression transmission member 18.

In the present embodiment, the depression transmission member 18 is made of a metal plate material, which is elongated and is partially curved or bent in shape. Instead, it is possible to use other materials such as a leather or resin band having flexibility or elasticity, a timing belt, a chain, etc.

The foot board 3 is made of a substantially flat board is of a sufficiently large size, which may substantially match the standard size of an operator's foot. In addition, a backend portion 17*b* of the foot board 17 is interconnected with the heel 3A in a free rotation manner via an interconnection pin 21, while the front end portion 17*a* of the foot board 17 is normally pressed upwards by a restoration spring 22 (see FIGS. 2 and 4). That is, the upper end of the restoration spring 22 is hooked on a cam plate 23 that is arranged on one end of the rotation shaft 12, while the lower end of the restoration spring 22 is stopped by a spring receiver 24 that is arranged on the lower end portion of the support member 2B (see FIG. 2).

Next, a description will be given with respect to the structure of the base plate 4, which constructs an important portion of the present invention.

As shown in FIGS. 4 and 5, the lower surface of the frame body 2A has two screws 31 for fixing prescribed parts thereto, a single screw (or stopper) 32 for stopping the base plate 4, and two projections 33 for use in positioning and avoidance of unwanted rotation of the pedal frame 2 on the floor surface. The two screws 31 are arranged at prescribed positions in proximity to the front side of the frame body 2A. The head portion of the single screw (or stopper) 32 projects downwardly from approximately the center of the frame body 2A, wherein it is constituted by a head 32A having a thin disk-like shape and an external thread portion 32B that is screwed into the frame body 2A in its thickness direction. As shown in FIG. 5, a single slot 35 is formed on the head 32A of the screw 32. The aforementioned projections 33 are used to establish prescribed positioning with respect to a front portion 4A of the base plate 4 and to regulate forward-backward movements and/or leftward-rightward movements of the base plate 4, wherein they are constituted by heads of small screws (or vises) that are screwed into tapped holes formed at prescribed positions in both sides of the back area of the lower surface of the frame body 2A.

FIG. 6 shows the overall structure of the base plate 4, which is made of a metal plate having an appropriate thickness and is elongated along forward-backward directions to be ranged from the back end portion of the frame body 2A (close to the side of a bass drum, not shown) to the back end portion of the heel 3A (close to the operator's side). Specifically, the front portion 4A of the base plate 4 may substantially match the shape of the lower surface of the frame body 2A; a center portion 4B of the base plate 4 substantially matches the shape of the foot board 3; and a back portion 4C of the base plate 4 substantially matches the shape of the heel 3A. In addition, a nonslip board 36 is attached to the lower surface of the front portion 4A of the base plate 4, and a nonslip board 40 is also attached to the lower surface of the back portion 4C of the base plate 4, wherein these boards are affixed using adhesive or small screws, for example. Furthermore, the center portion 4B of the base plate 4 is partially bent upwards in order to avoid unwanted contact with the floor surface as shown in FIG. 1.

The front portion 4A of the base plate 4 has two U-shaped slots for engagement with the screws 31, a through hole 44 for engagement with the screw 32, and two engagement holes 45 for engagement of the projections 33.

That is, the two U-shaped slots 43 are respectively opened at the front end of the front portion 4A of the base plate 4 and are formed to suit the screws 31, wherein the heads of the screws 31 are respectively inserted into and engaged with the slots 43. The through hole 44 has a keyhole shape consisting of two parts, namely, a circular portion 44A and an extended portion 44B, wherein the extended portion 44B whose width is smaller than the width (or diameter) of the circular portion 44 is communicated with the circular portion 44A and is extended in the backward direction of the base plate 4. In addition, the through hole 44 is arranged relatively close to the front end of the front portion 4A of the base plate 4 between the two U-shaped slots 43. The diameter of the circular portion 44A of the through hole 44 is slightly greater than the outer diameter of the head 32A of the screw 32. In addition, the width of the extended portion 44B of the through hole 44 is slightly greater than the outer diameter of the external thread portion 32B of the screw 32 and is slightly smaller than the outer diameter of the head 32A of the screw 32. Furthermore, the two engagement holes 45 are formed at prescribed positions in proximity to both sides of the back end of the front portion 4A of the base plate 4.

As shown in FIG. 3, the nonslip board 36 has two U-shaped slots 50 and a single elongated hole 51 in conformity with the aforementioned structure of the front portion 4A of the base plate 4, wherein when the nonslip board 36 is attached to the backside surface of the front portion 4A of the base plate 4, the two U-shaped slots 50 substantially match the aforementioned two U-shaped slots 43 in positions, and the elongated hole 51 substantially matches the aforementioned through hole 44 in position. That is, the U-shaped slots 50 of the nonslip board 36 are formed in substantially the same size and shape of the U-shaped slots 43 of the front portion 4A of the base plate 4, so that these slots can be respectively overlapped with each other. This allows the screws 31 to be easily fastened or loosened through the slots 43 and 50 overlapped with each other in the vertical direction. In addition, the elongated hole 51 has an oval shape (or an elongated circular shape) whose width substantially matches the diameter of the circular portion 44A of the through hole 44 and which is elongated in forward-backward directions, so that the head 32A of the screw 32 can be completely inserted into or hidden inside of the elongated hole 51. Cutouts 56 are formed at corners of the back end of the nonslip board 36 in order to avoid contacts or overlaps with the aforementioned projections 33 projected downwardly from the lower surface of the frame body 2A. In order to avoid occurrence of slips or skids on the floor surface, triangular projections 57 (having triangular cross sections) and grooves 58 are alternately arranged along the forward-backward direction and are entirely formed on the backside surface of the nonslip board 36. Incidentally, the heads of the screws 31 are completely embedded within the U-shaped slots 50 of the nonslip board 36, so that they do not project downwardly below the backside surface of the nonslip board 36 attached to the front portion 4A of the base plate 4, which is attached to the lower surface of the frame body 2A. Similarly, the screw 32 is tightly fastened with the frame body 2A through the through hole 44 of the base plate 4 and the elongated hole 51 of the nonslip board 36, so that the head 32A of the screw 32 does not project downwardly below the backside surface of the nonslip board 36 attached to the front portion 4A of the base plate 4, which is attached to the lower surface of the frame body 2A.

Similar to the aforementioned nonslip board 36 that is attached to the front portion 4A of the base plate 4 relative to the lower surface of the frame body 2A, triangular projections 59 (having triangular cross sections) and grooves 60 are alternately arranged and are entirely formed on the backside surface of the nonslip board 40 attached to the back portion 4C of the base plate 4, which is attached to the lower surface of the heel 3A.

Incidentally, the back portion 4C of the base plate 4 is attached to the heel 3A by use of a screw 70, which is embedded in the heel 3A and which is covered with the nonslip board 40. Therefore, the screw 70 is completely hidden and is covered with the nonslip board 40.

Moreover, it is possible to form positioning projections and engagement holes with respect to the heel 3A, as similar to the aforementioned projections 33 and engagement holes 45 that are arranged with respect to the frame body 2A.

Next, a description will be given with respect to procedures for attaching the base plate 4 to the pedal frame 2.

(1) Firstly, the nonslip board 36 is combined with the lower surface of the front portion 4A of the base plate 4 so that the U-shaped slots 50 and the elongated hole 51 will match the U-shaped slots 43 and the through hole 44 in positions respectively. Then, the nonslip board 36 is affixed to the front portion 4A of the base plate 4 by use of adhesive and screws, for example.

(2) Similarly, the nonslip board 40 is combined with the lower surface of the back portion 4C of the base plate 4; and then, the nonslip board 40 is affixed to the back portion 4C of the base plate 4 by use of adhesive or screws, for example.

(3) Thereafter, the front portion 4A of the base plate 4 is combined with the lower surface of the frame body 2A so that the screws 31 are respectively positioned inside of the U-shaped slots 43 and 50 matching each other in positions, and the head 32A of the screw 32 is inserted into the circular portion 44A of the through hole 44 formed in the front portion 4A of the base plate 4. Then, the base plate 4 is moved in the forward direction along the lower surface of the frame body 2A so that the external thread portion 32B of the screw 32 is moved into the extended portion 44B of the through hole 44. Thus, the aforementioned projections 33 of the frame body 2A are engaged with the engagement holes 45 formed in the front portion 4A of the base plate 4. Then, the screw 32 is tightly fastened using a screwdriver (not shown) having a flat tip or blade, so that the front portion 4A of the base plate 4 is firmly fixed to the lower surface of the frame body 2A. Thus, it is possible to complete operations for fixing the base plate 4 to the pedal frame 2. Incidentally, the nonslip board 36 is not necessarily affixed to the base plate 4 before fixed to the pedal frame 2. That is, it is possible to affix the nonslip board 36 to the base plate 4 after the front portion 4A of the base plate 4 is fixed to the lower surface of the frame body 2A of the pedal frame 2.

When the foot pedal 1 is disassembled and is safely kept in a prescribed space, the screw 32 is firstly loosened to release the fixed state of the front portion 4A of the base plate 4 that is fixed to the lower surface of the frame body 2A. At this time, the screw 32 is not necessarily removed from the lower surface of the frame body 2A. That is, the screw 32 is merely loosened to release engagement between the projections 33 and the engagement holes 45.

Next, the base plate 4 is moved backwards so that the external thread portion 32B of the screw 32 initially engaged with the extended portion 44B of the through hole 44 is moved into the circular portion 44A of the through hole 44. Then, the head 32A of the screw 32 is pulled out from the circular portion 44A of the through hole 44. Thus, it is possible to separate the base plate 4 from the frame body 2A. Thereafter, the aforementioned depression transmission member 18 is removed from the rocker 14, so that the foot board 3 can be completely separated from the pedal frame 2.

In addition, the beater rod 16 is removed from the rocker 14, so that the foot pedal 1 can be disassembled in a compact size and be safely kept in a prescribed space.

The aforementioned structure for attaching the base plate 4 to the pedal frame 2 is constituted using a single screw 32, by which the front portion 4A of the base plate 4 is fixed to the lower surface of the frame body 2A. This allows the operator to easily attach and detach the base plate 4 with the pedal frame 2. Since the screw 32 is projected downwardly from the lower surface of the frame body 2A, it may not be directly viewed by the others, and it does not lead the foot pedal 1 to be increased in width dimensions. Therefore, it is possible to improve the exterior appearance of the foot pedal 1.

In addition, after the head 32A of the screw 32 is inserted into the circular portion 44A of the through hole 44, the base plate 4 is moved forwards along the lower surface of the frame body 2A, so that the external thread portion 32B of the screw 32 can be reliably engaged into the extended portion 44B of the through hole 44. This eliminates the necessity of removing the screw 32 from the frame body 2A when disassembling the foot pedal 1. That is, it is possible to avoid the screw 32 being missing.

Furthermore, the projections 33 are engaged with the engagement holes 45 of the base plate 4 when combined with the pedal frame 2. Therefore, it is possible to establish prescribed positioning with respect to the base plate 4 relative to the frame body 2A. Thus, it is possible to avoid misfit of the base plate 4, which may be unexpectedly moved in forward-backward directions and/or rightward-leftward directions, and it is possible to reliably avoid unwanted rotation of the base plate 4.

In the present embodiment, the base plate 4 has the through hole 44 shaped like a keyhole, into which the screw 32 for fixing together the base plate 4 and the pedal frame 2 is inserted. This invention is not necessarily limited to the present embodiment; that is, the through hole 44 is not necessarily shaped like a keyhole. For example, it is possible to modify the through hole 44 to be a U-shaped hole that is opened at one end, wherein it is possible to reliably engage the screw 32 into the U-shaped hole by moving the front portion 4A of the base plate 4 along the lower surface of the frame body 2A.

The present embodiment is designed in such a way that the projections 33 are formed at prescribed positions of the lower surface of the pedal frame 2, while the engagement holes 45 are formed at prescribed positions of the base plate 4. It is possible to reverse such a relationship between the projections and engagement holes, wherein the projections can be formed on the base plate 4 while the engagement holes can be formed on the lower surface of the pedal frame 2, for example. Furthermore, pairs of projections and engagement holes are not necessarily used to establish engagement between the base plate 4 and pedal frame 2. For example, the engagement holes can be replaced with cutouts (similar to cutouts 56 shown in FIG. 3), which may be formed at prescribed corner positions of the front portion 4A of the base plate 4.

As described heretofore, this invention has a variety of effects and technical features, which will be described below.

(1) In a foot pedal for a drum according to this invention, a rocker is fixed to approximately the center of a rotation shaft that is rotatably supported between upper ends of support members, which are planted on both sides of a pedal frame. A beater rod having a beater for actually beating the drumhead of a bass drum is fixed to the rocker, which is interconnected with the front end of a foot board via a depression transmission member. A heel of the foot board is interconnected with the pedal frame by means of a base plate (or a stabilizing board). Herein, the base plate is combined with the pedal frame in such a way that the front portion of the base plate is fixed to the lower surface of the pedal frame by use of a screw, which is screwed into a prescribed position of the lower surface of the frame body of the pedal frame so that the head thereof is also located inside of a through hole formed at a prescribed position of the front portion of the base plate, wherein both the pedal frame and base plate are firmly engaged with each other by using prescribed engagement means.

(2) When the aforementioned foot pedal is disassembled, the screw is merely loosened to release engagement between the pedal frame and base plate; and then, the head of the screw is pulled out from the through hole of the base plate, so that the pedal frame can be safely removed from the pedal frame without completely removing the screw from the pedal frame. Herein, this invention requires a single screw that is projected downwardly from the lower surface of the pedal frame and that can reliably fix the base plate to the pedal frame when tightened. Therefore, it is unnecessary to increase width dimensions of the pedal frame to which the base plate is detachably attached.

(3) The aforementioned engagement means can be constituted using projections and engagement holes, which are arranged for the frame body of the pedal frame and the base plate respectively. Therefore, it is possible to reliably regulate unwanted forward-backward movements and/or leftward-rightward movements of the base plate relative to the pedal frame.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A foot pedal for a drum comprising:

a pedal frame constituted by a frame body and a pair of support members, the support members being disposed on an upper surface of the frame body;

a rotation shaft that is bridged and rotatably supported between upper ends of the support members;

a rocker fixed to the rotation shaft;

a beater rod having a beater, which is attached to the rocker;

a foot board whose front end is interconnected with the rocker via a depression transmission member and whose back end is interconnected with a heel;

a base plate having a front portion and a back portion, the front portion being affixed to a lower surface of the frame body, the back portion being affixed to a lower surface of the heel;

a screw fixing the front portion of the base plate and the lower surface of the frame body, wherein the screw has a head and an external thread portion that are projected from the lower surface of the frame body and are engaged with a through hole that is formed in the front portion of the base plate, so that when the base plate is combined with the frame body of the pedal frame, the screw is tightened to fix the base plate and the frame body of the pedal frame together; and an engagement means for appropriately positioning the front portion of the base plate and the lower surface of the frame body.

2. The foot pedal for a drum according to claim 1, wherein the through hole has a keyhole shape consisting of a circular portion and an extended portion that is extended from the circular portion toward the back portion of the base plate, the extended portion having a prescribed width smaller than a diameter of the circular portion, so that the external thread portion of the screw initially engaged with the circular portion of the through hole of the base plate is moved backwards and is engaged with the extended portion of the through hole when the base plate is moved backwards in order to combine the base plate and the frame body of the pedal frame together.

3. A foot pedal for a drum comprising:

a pedal frame constituted by a frame body and a pair of support members, the support members being disposed on an upper surface of the frame body;

a rotation shaft that is bridged and rotatably supported between upper ends of the support members;

a rocker fixed to the rotation shaft;

a beater rod having a beater, which is attached to the rocker;

a foot board whose front end is interconnected with the rocker via a depression transmission member and whose back end is interconnected with a heel; and a base plate whose front portion is affixed to a lower surface of the frame body of the pedal frame and whose back portion is affixed to a lower surface of the heel, wherein the front portion of the base plate and the lower surface of the frame body of the pedal frame are firmly fixed to each other using a screw;

a pair of projections that are arranged at prescribed positions in a back area of the lower surface of the frame body; and a pair of engagement holes that are formed at prescribed positions in the front portion of the base plate, so that the projections are respectively engaged with the engagement holes when the base plate is combined with the frame body of the pedal frame in g prescribed position.

4. The foot pedal for a drum according to claim 3 further comprising a nonslip board that is attached to a backside surface of the front portion of the base plate, wherein the nonslip board has an elongated hole substantially matched with the through hole of the base plate.

5. The foot pedal for a drum according to claim 3 further comprising a first nonslip board that is attached to a backside surface of the front portion of the base plate and that has an elongated hole substantially matched with the through hole of the base plate, and a second nonslip board that is attached to a backside surface of the back portion of the base plate.

6. The foot pedal for a drum according to claim 1, wherein the engagement means is constituted by a pair of projections that are arranged at prescribed positions in a back area of the lower surface of the frame body of the pedal frame, and a pair of engagement holes that are formed at prescribed positions of the front portion of the base plate, so that the projections are respectively engaged with the engagement holes when the base plate is combined with the frame body of the pedal frame in a prescribed positioning.

7. The foot pedal for a drum according to claim 1 further comprising a nonslip board that is attached to a backside surface of the front portion of the base plate, wherein the nonslip board has an elongated hole substantially matched with the through hole of the base plate.

8. The foot pedal for a drum according to claim 1 further comprising a first nonslip board that is attached to a backside surface of the front portion of the base plate and that has an elongated hole substantially matched with the through hole of the base plate, and a second nonslip board that is attached to a backside surface of the back portion of the base plate.

* * * * *